US006401289B1

(12) United States Patent
Herbert

(10) Patent No.: US 6,401,289 B1
(45) Date of Patent: Jun. 11, 2002

(54) SKIN CLEANING DEVICE

(76) Inventor: Linda S. Herbert, P.O. Box 963, Orem, UT (US) 84059

( * ) Notice: Subject to any disclaimer, the term of this patent is extended or adjusted under 35 U.S.C. 154(b) by 0 days.

(21) Appl. No.: 09/939,021

(22) Filed: Aug. 24, 2001

(51) Int. Cl.[7] ..... A61H 7/00; A46B 13/02

(52) U.S. Cl. ..... 15/97.1; 601/114; 601/137; 601/138

(58) Field of Search ..... 15/97.1; 601/114, 601/137, 138

(56) References Cited

U.S. PATENT DOCUMENTS 4,131,966 A * 1/1979 Gross
4,282,623 A 8/1981 Gacuzana
4,964,398 A 10/1990 Jones
5,138,735 A * 8/1992 Kusz
5,187,827 A 2/1993 Wei
5,495,632 A * 3/1996 Baker
5,718,014 A 2/1998 De Blois et al.
D403,864 S 1/1999 Holland et al.
5,956,792 A 9/1999 Gutelius et al.

* cited by examiner

*Primary Examiner*—Randall E. Chin

(57) ABSTRACT

A skin cleaning device for removing dirt, oils and dead skin. The skin cleaning device includes a housing having a first end and a second end. The first end has a cavity extending therein. A motor is positioned in the housing and is located generally adjacent to the second end. A shaft is mechanically coupled to the motor and extends through the second end of the housing. The motor is adapted for rotating the shaft. The shaft has a free end defining a female coupler. A power supply is operationally coupled to the motor. A disc has a first side and a second side. The first side has a convex shape. A male coupler is integrally attached to the second side and is generally centrally located on the second side of the disc. The male coupler is removably insertable into the female coupler for releasably attaching the disc to the shaft. A plurality of cleaning pads each has a peripheral edge. An elastic member is attached to and extends around the peripheral edge such that each of the pads forms a sock positionable over the first side of the disc. The motor rotates the disc such that the pads may be used for cleaning skin of the user.

12 Claims, 3 Drawing Sheets

SKIN CLEANING DEVICE

BACKGROUND OF THE INVENTION

1. Field of the Invention

The present invention relates to skin cleaners and more particularly pertains to a new skin cleaning device for removing dirt, oils and dead skin.

2. Description of the Prior Art

The use of skin cleaners is known in the prior art. More specifically, skin cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,956,792; U.S. Pat. No. 5,718,014; U.S. Pat. No. 5,187,827; U.S. Pat. No. 4,282,623; U.S. Pat. No. 4,946,398; and U.S. Pat. No. 403,864.

While these devices fulfill their respective, particular objectives and requirements, the aforementioned patents do not disclose a new skin cleaning device. The inventive device includes a housing having a first end and a second end. The first end has a cavity extending, therein. A motor is positioned in the housing and is located generally adjacent to the second end. A shaft is mechanically coupled to the motor and extends through the second end of the housing. The motor is adapted for rotating the shaft. The shaft has a free end defining a female coupler. A power supply is operationally coupled to the motor. A disc has a first side and a second side. The first side has a convex shape. A male coupler is integrally attached to the second side and is generally centrally located on the second side of the disc. The male coupler is removably insertable into the female coupler for releasably attaching the disc to the shaft. A plurality of cleaning pads each has a peripheral edge. An elastic member is attached to and extends around the peripheral edge such that each of the pads forms a sock positionable over the first side of the disc. The motor rotates the disc such that the pads may be used for cleaning skin of the user.

In these respects, the skin cleaning device according to the present invention substantially departs from the conventional concepts and designs of the prior art, and in so doing provides an apparatus primarily developed for the purpose of removing dirt, oils and dead skin.

SUMMARY OF THE INVENTION

In view of the foregoing disadvantages inherent in the known types of skin cleaners now present in the prior art, the present invention provides a new skin cleaning device construction wherein the same can be utilized for removing dirt, oils and dead skin.

The general purpose of the present invention, which will be described subsequently in greater detail, is to provide a new skin cleaning device apparatus and method which has many of the advantages of the skin cleaners mentioned heretofore and many novel features that result in a new skin cleaning device which is not anticipated, rendered obvious, suggested, or even implied by any of the prior art skin cleaners, either alone or in any combination thereof.

To attain this, the present invention generally comprises a housing having a first end and a second end. The first end has a cavity extending therein. A motor is positioned in the housing and is located generally adjacent to the second end. A shaft is mechanically coupled to the motor and extends through the second end of the housing. The motor is adapted for rotating the shaft. The shaft has a free end defining a female coupler. A power supply is operationally coupled to the motor. A disc has a first side and a second side. The first side has a convex shape. A male coupler is integrally attached to the second side and is generally centrally located on the second side of the disc. The male coupler is removably insertable into the female coupler for releasably attaching the disc to the shaft. A plurality of cleaning pads each has a peripheral edge. An elastic member is attached to and extends around the peripheral edge such that each of the pads forms sock positionable over the first side of the disc. The motor rotates the disc such that the pads may be used for cleaning skin of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is either intended to define the invention of the application, which is measured by the claims, nor is it intended to be limiting as to the scope of the invention in any way.

It is therefore an object of the present invention to provide a new skin cleaning device apparatus and method which has many of the advantages of the skin cleaners mentioned heretofore and many novel features that result in a new skin cleaning device which is not anticipated, rendered obvious, suggested, or even implied by any of the prior art skin cleaners, either alone or in any combination thereof.

It is another object of the present invention to provide a new skin cleaning device which may be easily and efficiently manufactured and marketed.

It is a further object of the present invention to provide a new skin cleaning device which is of a durable and reliable construction.

An even further object of the present invention is to provide a new skin cleaning device which is susceptible of a low cost of manufacture with regard to both materials and labor, and which accordingly is then susceptible of low prices of sale to the consuming public, thereby making such skin cleaning device economically available to the buying public.

Still yet another object of the present invention is to provide a new skin cleaning device which provides in the apparatuses and methods of the prior art some of the advantages thereof, while simultaneously overcoming some of the disadvantages normally associated therewith.

Still another object of the present invention is to provide a new skin cleaning device for removing dirt, oils and dead skin.

Yet another object of the present invention is to provide a new skin cleaning device which includes a housing having a first end and a second end. The first end has a cavity extending therein. A motor is positioned in the housing and is located generally adjacent to the second end. A shaft is mechanically coupled to the motor and extends through the second end of the housing. The motor is adapted for rotating the shaft. The shaft has a free end defining a female coupler. A power supply is operationally coupled to the motor. A disc has a first side and a second side. The first side has a convex shape. A male coupler is integrally attached to the second side and is generally centrally located on the second side of the disc. The male coupler is removably insertable into the female coupler for releasably attaching the disc to the shaft. A plurality of cleaning pads each has a peripheral edge. An elastic member is attached to and extends around the peripheral edge such that each of the pads forms sock positionable over the first side of the disc. The motor rotates the disc such that the pads may be used for cleaning skin of the user.

Still yet another object of the present invention is to provide a new skin cleaning device that has removable pads which may be selected for coarseness depending on the type of skin being cleaned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
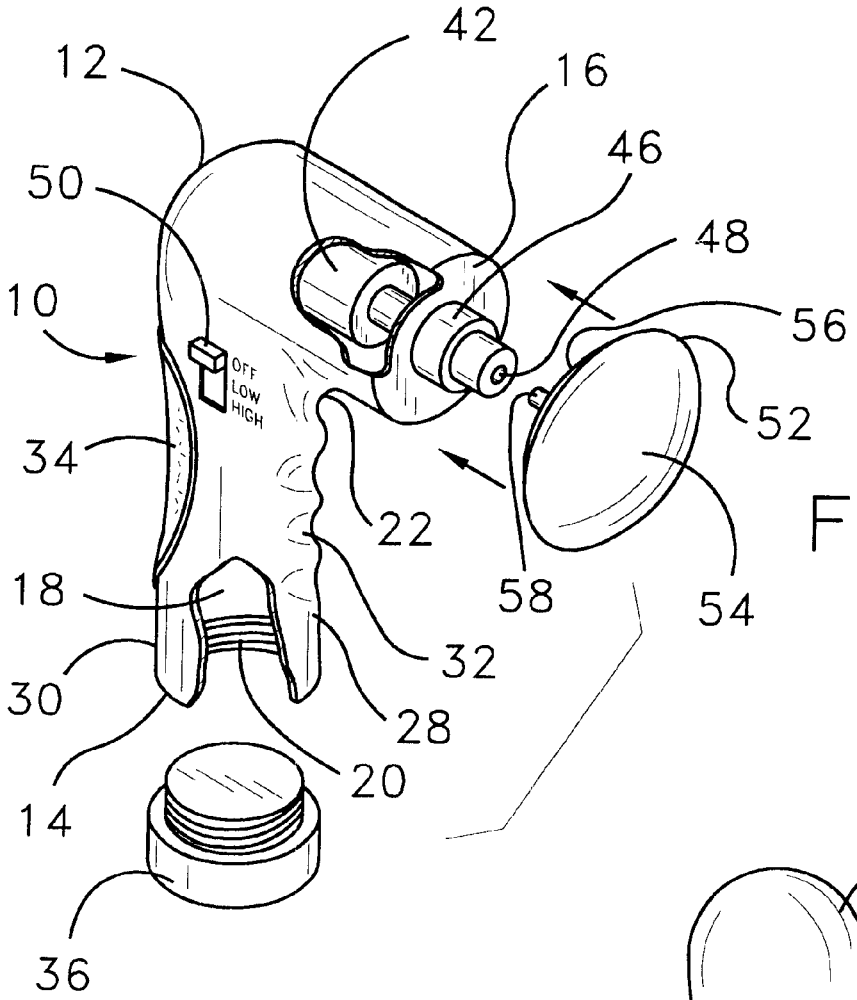
FIG. 1 is a schematic perspective view of a new skin cleaning device according to the present invention.
Figure 2:
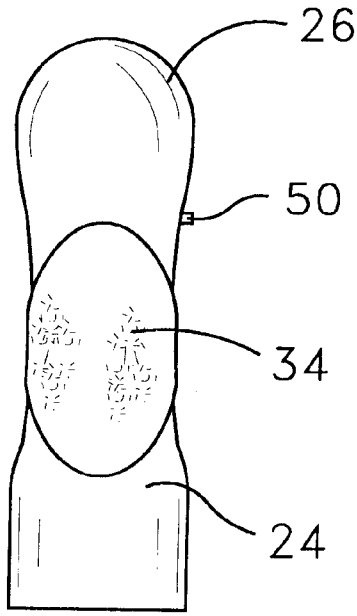
FIG. 2 is a schematic back view of the present invention.
Figure 3:
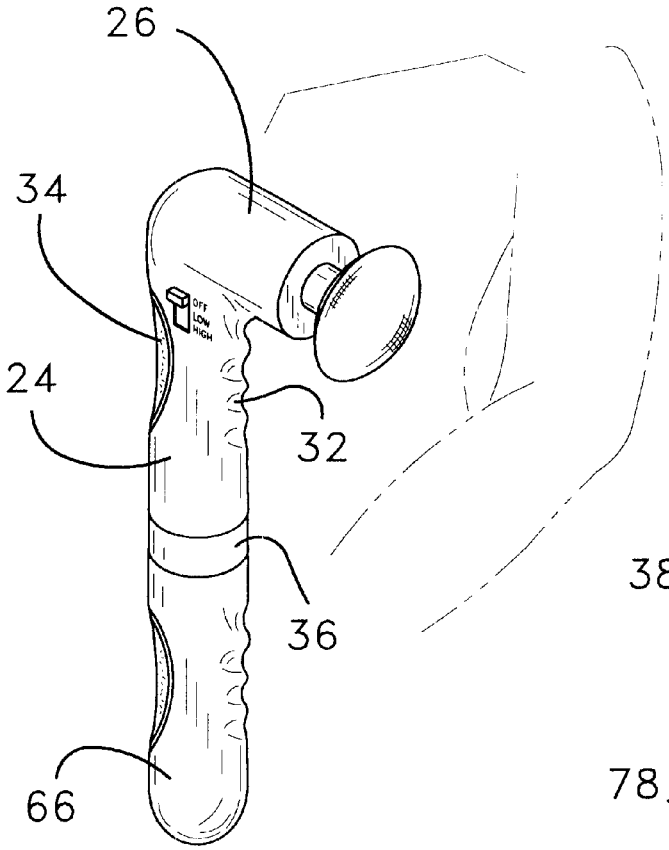
FIG. 3 is a schematic perspective view of the present invention.
Figure 4:
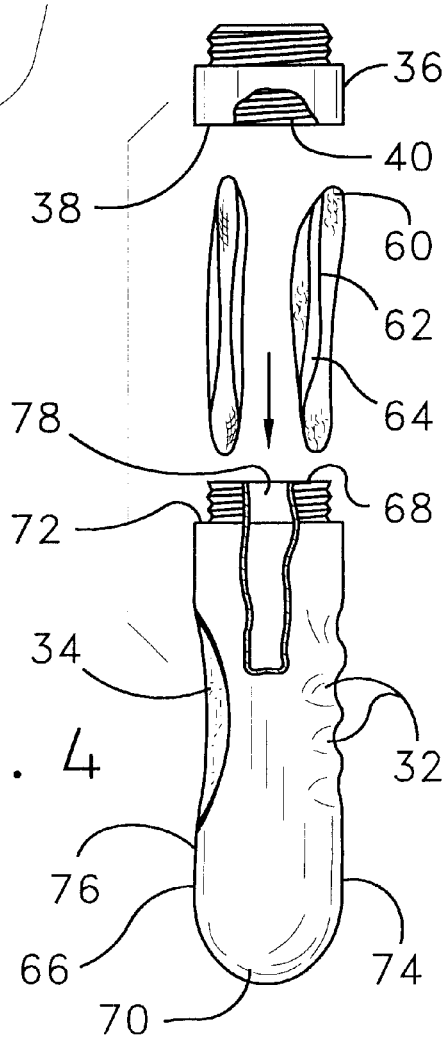
FIG. 4 is a schematic side view of the present invention.
Figure 5:
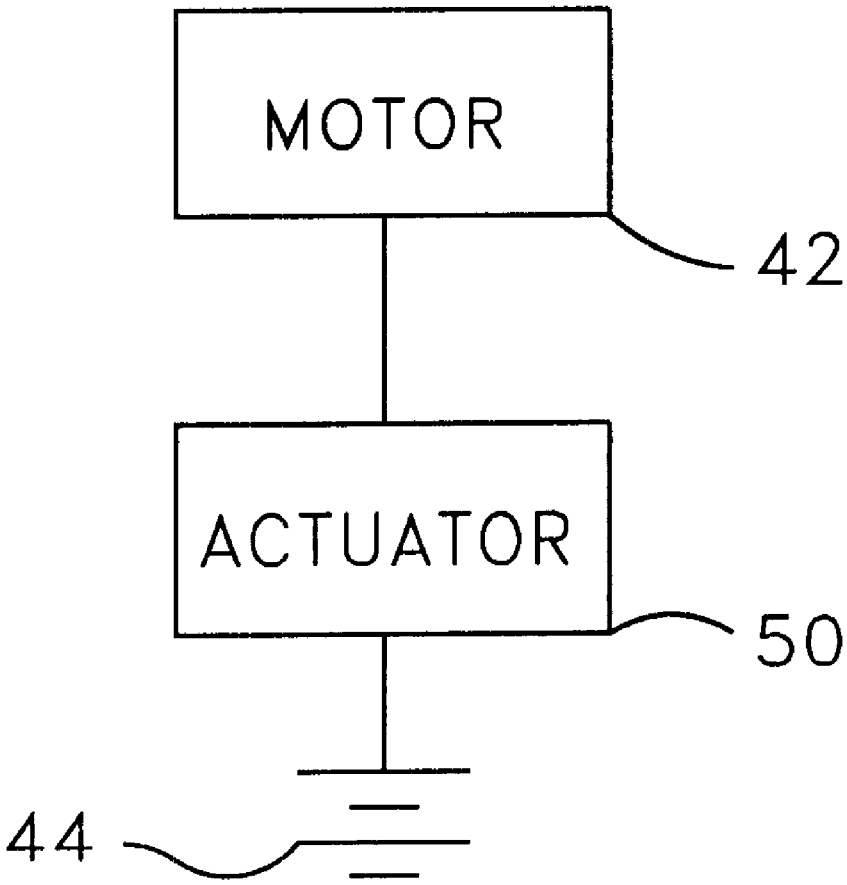
FIG. 5 is a schematic view of the present invention.

With reference now to the drawings, and in particular to FIGS. 1 through 5 thereof, a new skin cleaning device embodying the principles and concepts of the present invention and generally designated by the reference numeral 10 will be described.

As best illustrated in FIGS. 1 through 5, the skin cleaning device 10 generally comprises a housing 12 having a first end 14 and a second end 16. The first end 14 has a cavity 18 extending therein. The cavity 18 defines a battery compartment. The cavity 18 has a threaded peripheral wall 20. The housing 12 has a bend 22 therein generally positioned between the first 14 and second 16 ends such that a first portion 24 is defined adjacent to the first end 14 and a second portion 26 is defined adjacent to the second end 26. The bend 22 is generally equal to ninety degrees. The first portion 24 has a first side 28 generally facing in the direction of extension of the second portion 26 and a second side 30 positioned opposite of the first side 28. The first side 28 has a plurality of indentations 32 aligned from the second portion 26 to the first end 14. The indentations 32 define finger grips for receiving fingers of a user. The second side 30 has an elongated arcuate depression 34 therein for receiving a palm of the user.

A cap 36 is extendable into the cavity 18 for selectively opening and closing the cavity 18. The cap 36 is threaded for threadably engaging the peripheral wall 20 of the cavity 18. The cap 36 has a distal end 38 with respect to the housing 12 having a threaded hole 40 therein.

A motor 42 is positioned in the second portion 26. The motor 42 is an electrical motor and is adapted for operating at variable speeds.

A power supply 44 is operationally coupled to the motor 42. The power supply 44 preferably comprises at least one battery removably positioned in the battery compartment 18, though an electrical cord may also be used.

A shaft 46 is mechanically coupled to the motor 42 and extends through the second end 16 of the housing 12. The motor 42 is adapted for rotating the shaft 46. The shaft 46 has a free end 48 defining a female coupler.

An actuator 50 selectively turns the motor 42 on or off and may be used for selectively choosing one of the variable speeds. The actuator 50 is operationally coupled to the motor 42 and is mounted on the first portion 24 of the housing 12.

A disc 52 has a first side 54 and a second side 56. The first side 54 has a convex shape. A male coupler 58 is integrally attached to the second side 56 and is generally centrally located on the second side of the disc 52. The male coupler 58 is removably insertable into the female coupler 48 for releasably attaching the disc 52 to the shaft 46.

A plurality of cleaning pads 60 each has a peripheral edge 62. An elastic member 64 is attached to and extends around the peripheral edges 62 such that each of the pads 60 forms a sock positionable over the first side 54 of the disc 52. The each of the cleaning pads 60 preferably comprises a cotton material but the material may vary depending on use and need.

An extension rod 66 is elongated and has a first end 68 and a second end 70. The rod 66 has a shoulder 72 therein positioned nearer the first end 68 than the second end 70. The rod 66 is threaded from the shoulder 72 to the first end 68. A threaded portion of the rod 66 is extendable in and threadably coupled to the hole 40 in the cap 36. The rod 66 has a first side 74 and a second side 76 alignable with a respective one of the first 28 and second 30 sides of the first portion 24. The first side 74 of the rod 66 has a plurality of indentations 32 aligned from the shoulder 72 to the second end 70 of the rod 66. The indentations 32 define finger grips for receiving fingers of the user. The second side 76 of the rod 66 has an elongated arcuate depression 34 therein for receiving a palm of the user. The first end 68 of the rod 66 has a bore 78 extending therein for storing the pads 60.

In use, the user places one of the pads 60 over the disc 52 such that the elastic member 64 holds the pad 60 on the disc 52. The motor 42 rotates the disc 52 such that the pads 60 may be used for cleaning skin of the user. The type of cloth used for the pads 60 may be changed depending on where the person is cleaning. Thus a coarser cloth may be used for the feet. The extension rod 66 holds the extra pads 60 and allows the user to use the device 10 with two hands.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A skin cleaning device for cleaning the skin of a user of the device, said device comprising:

a housing having a first end and a second end, said first end having a cavity extending therein;

a motor being positioned in said housing and generally adjacent to said second end;

a shaft being mechanically coupled to said motor and extending through said second end of said housing, said motor being adapted for rotating said shaft, said shaft having a free end defining a female coupler;

a power supply being operationally coupled to said motor;

a disc having a first side and a second side, said first side having a convex shape, a male coupler being integrally attached to said second side and being generally centrally located on said second side of said disc, said male coupler being removably insertable into said female coupler for releasably attaching said disc to said shaft;

a plurality of cleaning pads each having a peripheral edge, an elastic member being attached to and extending around said peripheral edge such that each of said pads forms a sock positionable over said first side of said disc; and wherein said motor rotates said disc such that said pads may be used for cleaning skin of the user.

2. The skin cleaning device as in claim 1, wherein said first end has a cavity extending therein, said cavity defining a battery compartment, said power supply comprising at least one battery positioned in said battery compartment.

3. The skin cleaning device as in claim 2, further comprising:

said cavity having a threaded peripheral wall; and a cap being extendable into said cavity for selectively opening and closing said cavity, said cap being threaded for threadably engaging said peripheral wall of said cavity.

4. The skin cleaning device as in claim 3, further including:

said cap having a distal end with respect to said housing having hole therein, said hole being threaded; and an extension rod being elongated and having a first end and a second end, said rod having a shoulder therein positioned nearer said first end than said second end, said rod being threaded from said shoulder to said first end, a threaded portion of said rod being extendable in and threadably coupled to said hole in said cap.

5. The skin cleaning device as in claim 4, wherein said rod has a first side and a second side, said first side of said rod having a plurality of indentations being aligned from said shoulder to said second end of said rod, said indentations defining finger grips for receiving fingers of the user, said second side of said rod having an elongated arcuate depression therein for receiving a palm of the user.

6. The skin cleaning device as in claim 4, wherein said first end of said rod having a bore extending therein for storing said pads.

7. The skin cleaning device as in claim 1, wherein said housing has a bend therein generally positioned between said first and second ends such that a first portion is defined adjacent to said first end and a second portion is defined adjacent to said second end, said motor being located in said second portion, said bend being generally equal to ninety degrees.

8. The skin cleaning device as in claim 7, wherein said first portion having a first side generally facing in the direction of extension of said second portion and a second side positioned opposite of said first side, said first side having a plurality of indentations being aligned from said second portion to said first end, said indentations defining finger grips for receiving fingers of the user, said second side having an elongated arcuate depression therein for receiving a palm of the user.

9. The skin cleaning device as in claim 7, further including:

said motor being an electrical motor adapted for operating at variable speeds; and an actuator for selectively turning said motor on or off and for selectively choosing one of said variable speeds being operationally coupled to said motor, said actuator being mounted on said first portion of said housing.

10. The skin cleaning device as in claim 1, further including:

said motor being an electrical motor adapted for operating at variable speeds; and an actuator for selectively turning said motor on or off and for selectively choosing one of said variable speeds being operationally coupled to said motor, said actuator being mounted on said housing.

11. The skin cleaning device as in claim 1, wherein each of said cleaning pads comprises a cotton material.

12. A skin cleaning device for cleaning the skin of a user of the device, said device comprising:

a housing having a first end and a second end, said first end having a cavity extending therein, said cavity defining a battery compartment, said cavity having a threaded peripheral wall, said housing having a bend therein generally positioned between said first and second ends such that a first portion is defined adjacent to said first end and a second portion is defined adjacent to said second end, said bend being generally equal to ninety degrees, said first portion having a first side generally facing in the direction of extension of said second portion and a second side positioned opposite of said first side, said first side having a plurality of indentations being aligned from said second portion to said first end, said indentations defining finger grips for receiving fingers of the user, said second side having an elongated arcuate depression therein for receiving a palm of the user;

a cap being extendable into said cavity for selectively opening and closing said cavity, said cap being threaded for threadably engaging said peripheral wall of said cavity, said cap having a distal end with respect to said housing having hole therein, said hole being threaded;

a motor being positioned in said second portion, said motor being an electrical motor and being adapted for operating at variable speeds;

a power supply being operationally coupled to said motor, said power supply comprising at least one battery removably positioned in said battery compartment;

a shaft being mechanically coupled to said motor and extending through said second end of said housing, said motor being adapted for rotating said shaft, said shaft having a free end defining a female coupler;

an actuator for selectively turning said motor on or off and for selectively choosing one of said variable speeds being operationally coupled to said motor, said actuator being mounted on said first portion of said housing;

a disc having a first side and a second side, said first side having a convex shape, a male coupler being integrally attached to said second side and being generally centrally located on said second side of said disc, said male coupler being removably insertable into said female coupler for releasably attaching said disc to said shaft;

a plurality of cleaning pads each having a peripheral edge, an elastic member being attached to and extending around said peripheral edge such that each of said pads forms a sock positionable over said first side of said disc, each of said cleaning pads comprising a cotton material;

an extension rod being elongated and having a first end and a second end, said rod having a shoulder therein positioned nearer said first end than said second end, said rod being threaded from said shoulder to said first end, a threaded portion of said rod being extendable in and threadably coupled to said hole in said cap, said rod having a first side and a second side alignable with a respective one of said first and second sides of said first portion, said first side of said rod having a plurality of indentations being aligned from said shoulder to said second end of said rod, said indentations defining finger grips for receiving fingers of the user, said second side of said rod having an elongated arcuate depression therein for receiving a palm of the user, said first end of said rod having a bore extending therein for storing said pads; and wherein said motor rotates said disc such that said pads may be used for cleaning skin of the user.

* * * * *